US007882664B2

(12) United States Patent
Lundsgaard et al.

(10) Patent No.: US 7,882,664 B2
(45) Date of Patent: Feb. 8, 2011

(54) DECK-MOUNTED SKYLIGHT HAVING UNITARY CLADDING COMPONENT

(75) Inventors: Christian Aage Lundsgaard, Ry (DK); Charles Joseph Rimsky, Greenwood, SC (US)

(73) Assignee: VKR Holding A/S, Hoersholm (DK)

( * ) Notice: Subject to any disclaimer, the term of this patent is extended or adjusted under 35 U.S.C. 154(b) by 381 days.

(21) Appl. No.: 12/176,637

(22) Filed: Jul. 21, 2008

(65) Prior Publication Data

US 2010/0011683 A1 Jan. 21, 2010

(51) Int. Cl.
*E04B 7/18* (2006.01)

(52) U.S. Cl. ..... 52/200; 52/60; 52/58

(58) Field of Classification Search ..... 52/200, 52/58, 127.8, 72, 745.15, 60, 22
See application file for complete search history.

(56) References Cited

U.S. PATENT DOCUMENTS

| | | | | |
|---|---|---|---|---|
| 3,434,250 | A * | 3/1969 | Kiekhaefer | 52/22 |
| 3,455,073 | A * | 7/1969 | Kiekhaefer | 52/200 |
| 4,570,393 | A | 2/1986 | Minter | |
| 4,612,727 | A | 9/1986 | Eriksson | |
| 4,750,302 | A * | 6/1988 | Bechtold | 52/72 |
| 4,776,141 | A * | 10/1988 | Powell | 52/200 |
| 4,788,804 | A * | 12/1988 | Haas | 52/200 |
| 5,103,603 | A * | 4/1992 | Verby et al. | 52/72 |
| 5,148,643 | A * | 9/1992 | Sampson et al. | 52/200 |
| 5,199,234 | A * | 4/1993 | Guhl | 52/200 |
| 5,355,644 | A * | 10/1994 | Guhl et al. | 52/200 |
| 6,167,661 | B1 | 1/2001 | Christensen | |
| 6,263,623 | B1 * | 7/2001 | Weiss et al. | 52/200 |
| 6,263,624 | B1 * | 7/2001 | Hoy et al. | 52/200 |
| 7,331,145 | B2 * | 2/2008 | Feucht et al. | 52/58 |
| 7,624,547 | B1 * | 12/2009 | Brinton et al. | 52/200 |

FOREIGN PATENT DOCUMENTS

DE 19806612 A1 8/1999

OTHER PUBLICATIONS

International Search Report for corresponding PCT Application Serial No. PCT/DK2009/000177, prepared by the European Patent Office as International Searching Authority, dated Oct. 12, 2009.

* cited by examiner

*Primary Examiner*—Richard E Chilcot, Jr.
*Assistant Examiner*—Beth Stephan
(74) *Attorney, Agent, or Firm*—Turner Padget Graham & Laney

(57) ABSTRACT

Provided herein is a unitary U-shaped cladding component that surrounds three sides of a deck-mounted skylight frame. In one embodiment, the frame includes a pair of longitudinal members, each of which has a locking mechanism (such as a bendable tab or rotatable latch) on its exterior side near one end. The locking mechanism engages a corresponding lock-receiving slot of the side panels of the cladding component. In another embodiment, the cladding component includes a locking mechanism (such as a bendable tab) on the exterior surface of each end. The locking mechanisms engage corresponding apertures in a head flashing member. Skylight including these cladding components are also provided, as are methods of installing such cladding components.

22 Claims, 14 Drawing Sheets

Detail A

Detail B

DECK-MOUNTED SKYLIGHT HAVING UNITARY CLADDING COMPONENT

TECHNICAL FIELD

The present disclosure relates to the field of skylights and, more particularly, to deck-mounted skylights having a unitary cladding component surrounding three sides of the skylight.

BACKGROUND

Skylights and roof windows have been incorporated into buildings for decades as a way of introducing daylight and/or fresh air into a building interior. A skylight, which may be fixed or opening, typically is installed within a rooftop that is inaccessible from the building's interior without the use of a ladder. Most skylights include an insulated glass lens or covering element, a wood frame, and a protective cladding surrounding the wood frame. Some skylights may be mounted directly to the roof deck (those being referred to as "deck-mounted" skylights).

A roof window is designed for installation in homes or buildings where the roof is generally within reach of the building occupant. For example, roof windows may be installed in homes having low rooflines or in attics being used as living space. The roof window may possess a similar construction to a skylight, and may include opening, or ventilating, capability.

Such deck-mounted skylights and roof windows (collectively referred to herein as "skylights") typically comprise a wooden frame. As with any window, steps must be taken to ensure that the wooden frame is protected against deterioration or decay that may be caused by exposure to the elements. In the past, manufacturers have sought to address this problem by attaching a cladding component to each side of the skylight, typically with screws.

Although such cladding components are functionally adequate for their intended purpose, a significant difficulty arises during the installation of complementary flashing elements, which may desirably be installed between the cladding component and the underlying frame. Specifically, in practice, a roofer or carpenter must unscrew the cladding components from the preassembled skylight and retain the removed screws for later use. Once the flashing elements have been installed around the perimeter of the skylight, the installer must then orient the individual cladding components around the perimeter of the skylight and secure them with the aforementioned screws. One might readily imagine the difficulty in maneuvering individual cladding components (particularly for a large skylight) and the fastening screws, without dropping either the cladding component itself or the corresponding screws.

Accordingly, it would be desirable for a deck-mounted skylight to be provided with a single cladding component that may be readily attached to and removed from an installed skylight, without the need for tools or fasteners.

SUMMARY

Provided herein is a deck-mounted skylight installed about an opening in a building roof, the skylight including a covering element; a frame that surrounds the opening and supports the covering element; a sash that secures the covering element to the frame; and a unitary U-shaped cladding component that surrounds three sides of the frame. The frame may include a pair of longitudinal frame members and a pair of transverse frame members. The U-shaped cladding component includes a bottom panel and a pair of side panels extending from the bottom panel, such that, when the cladding component is slidably engaged with the frame, the bottom panel covers one of the transverse frame members and the side panels cover a majority of the length of the longitudinal frame members. The bottom panel and the side panels also include a profile that engages the sash.

In a first embodiment, the locking mechanism is attached to the frame, and the side panels of the cladding component include lock-receiving slots. Specifically, each of the longitudinal frame members includes a locking mechanism on an exterior side thereof at a location proximate an end of the longitudinal frame members. Further, each of the side panels of the cladding component includes a lock-receiving slot at an end thereof distal to the bottom panel through which lock-receiving slot the locking mechanism of the longitudinal frame member is received.

In one manner of practicing the first embodiment, the locking mechanism on each longitudinal side of the frame includes a bendable tab, and the lock-receiving slot of the cladding component is oriented to receive the bendable tab (that is, the slot is oriented in parallel to the end of the side panel).

According to another manner of practicing this embodiment, the locking mechanism on each longitudinal side of the frame comprises a rotatable latch, and the lock-receiving slot of the cladding component comprises an aperture having a profile engageable with the rotatable latch. The aperture extends in a direction perpendicular to the end of the side panel of the cladding component and may be in the form of a slot that terminates in a circular opening (that is, a slot having a "keyhole" shape).

Also provided herein is a first method for installing a cladding around a skylight, the method including providing a U-shaped cladding component, as described above; providing a skylight having a pair of transverse frame members and a pair of oppositely disposed longitudinal frame members, the longitudinal frame members including a locking mechanism at an upper end thereof; sliding the U-shaped cladding component onto the skylight, such that the one of the transverse frame members of the skylight is covered by the bottom panel of the U-shaped cladding component and a majority of the length of the longitudinal frame members is covered by the side panels of the U-shaped cladding component; and engaging the locking mechanisms of the longitudinal frame members with the lock-receiving slots of the respective side panels of the U-shaped cladding component.

In a second embodiment, the locking mechanism is attached to the cladding component and a head flashing member is provided, which includes lock-receiving slots. Specifically, the cladding component may include an outwardly projecting tab that is mechanically attached to the respective ends of the side panels of the cladding component. The tab may be L-shaped and may have an attachment panel and an engagement panel. Further, according to this aspect, a head flashing member is provided, the head flashing member having a C-shape complementary to the top of the skylight (that is, having a central portion and two arms extending from the central portion). Each arm of the head flashing member includes a slot for receipt of a corresponding engagement side of a tab on the cladding component. The tab is bendable about the slot to secure the cladding component to the head flashing member.

According to one manner of practicing the second embodiment, the tabs may be affixed to the cladding component, such that the engagement panels of the tabs are parallel to the plane of the covering element. The tabs are correspondingly aligned with the slots in the head flashing member, the slots being similarly oriented (i.e., in parallel to the covering element).

According to another manner of practicing the second embodiment, the tabs may be affixed to the cladding component, such that the engagement panels of the tabs are perpendicular to the plane of the covering element. The tabs are correspondingly aligned with the slots in the head flashing member, the slots being similarly oriented (i.e., perpendicularly to the covering element) and being located inward of the ends of the head flashing member.

A second method of installing cladding around a skylight includes providing a U-shaped cladding component having an outwardly projecting locking mechanism at each end, as described above; providing a skylight having a pair of transverse frame members and a pair of longitudinal frame members, the longitudinal frame members having a first length; sliding the U-shaped cladding component onto the skylight, such that one transverse frame member of the skylight is covered by the bottom panel of the U-shaped cladding component and a majority of the length of the longitudinal frame members is covered by the side panels of the cladding component; providing a head flashing member having a central portion and a pair of arms extending from the central portion, each arm of the head flashing member including a slot-shaped aperture at an end thereof for receipt of the corresponding locking mechanism; and engaging the locking mechanisms of the cladding component with the slots of the head flashing member. The locking mechanism may be a bendable tab.

In all embodiments, the present deck-mounted skylight may further include a headpiece that covers a portion of the upper transverse frame member and may further include a seamless deck-sealing surround attached to the frame members and to the roof.

BRIEF DESCRIPTION OF THE DRAWINGS

A full and detailed disclosure is set forth in the accompanying specification, which makes reference to the appended figures in which.

DETAILED DESCRIPTION

Reference is now made to the drawings for illustration of the various components used to produce a deck-mounted skylight having a unitary cladding component. Although the skylight assembly is shown and described as having a substantially flat construction employing flat glass panes, a domed-type skylight covering may instead be employed. Further, while reference is made throughout the disclosure to a skylight assembly, the present unitary cladding components may be equally well suited for use around a roof window. In addition, although the deck-mounted skylight may be shown and described as having a fixed configuration (in which the skylight does not open), a ventilating type of skylight may also be employed.

Figure 1:
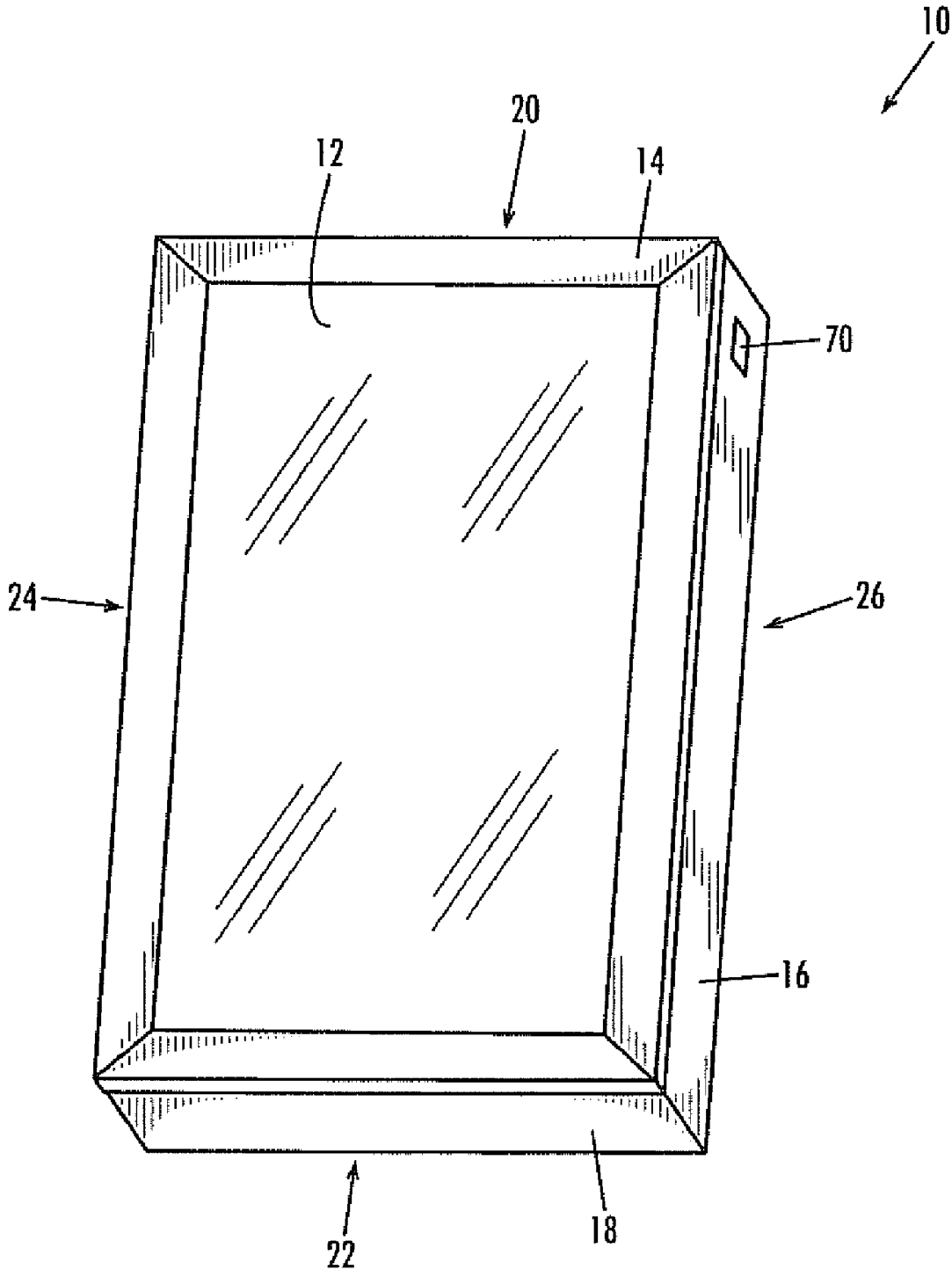
FIG. 1 is an isometric view of a deck-mounted skylight.

FIG. 1 is an isometric view of a deck-mounted skylight 10, according to a first aspect, which includes a covering element 12, a pair of longitudinal frame members 16, a pair of transverse frame members 18, and a plurality of sash members 14 that secure the covering element 12 to the frame members 16, 18. The deck-mounted skylight 10 has an upper side 20, a lower (or bottom) side 22, a left side 24, and a right side 26. A locking mechanism (exemplified in this illustration by the number 70) is attached to the exterior surface of each longitudinal frame member 16 at a location proximate one end of the longitudinal frame members (for example, proximate to, and equidistant from, the upper side 20 of the skylight 10).

Figure 2A:
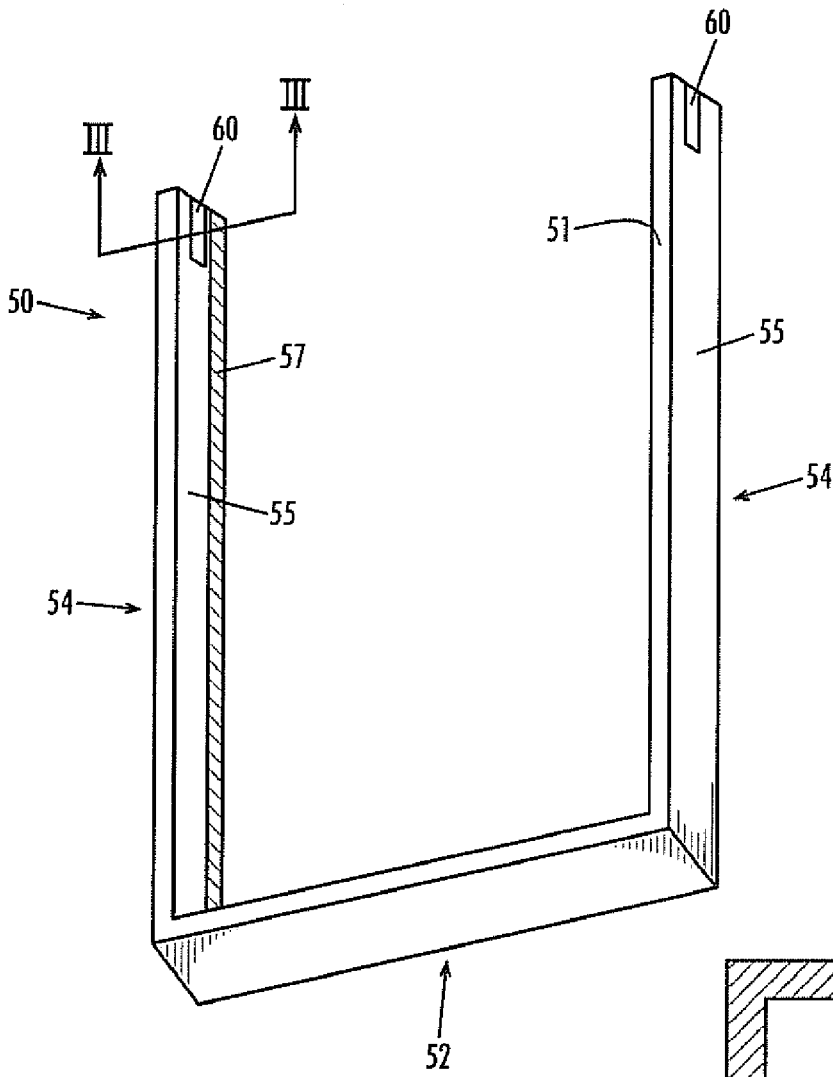
FIG. 2A is an isometric view of a unitary cladding component, according to a first embodiment of the present disclosure.
Figure 2B:
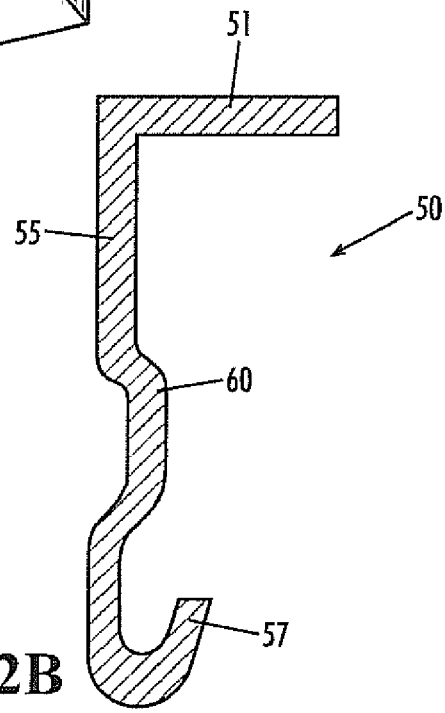
FIG. 2B is a cross-section of the unitary cladding component of FIG. 2A as taken along Line III-III.

A unitary U-shaped cladding component 50, according to a first embodiment of the present disclosure, may be seen in FIG. 2A. The U-shaped cladding component 50 includes a centrally located bottom panel 52 and a pair of side panels 54 extending from the bottom panel 52. The cladding component 50 may be configured with a profile complementary to the sash members 14 and the frame members 16, 18 of the skylight 10, such that the cladding component 50 may be held in place by virtue of its complementary shape. As may be seen with simultaneous reference to FIG. 21, the profile of the cladding component 50 may be defined by a horizontally extending shelf 51, a vertically extending wall 55, and a curved portion 57. The vertically extending wall 55 further includes a recessed area 60 having a slot-shaped aperture (for example, 62) for receipt of a locking mechanism (for example, 70) the recessed area 60 being located at the ends of the longitudinal side panels 54 distal to the bottom panel 52.

Figure 3:
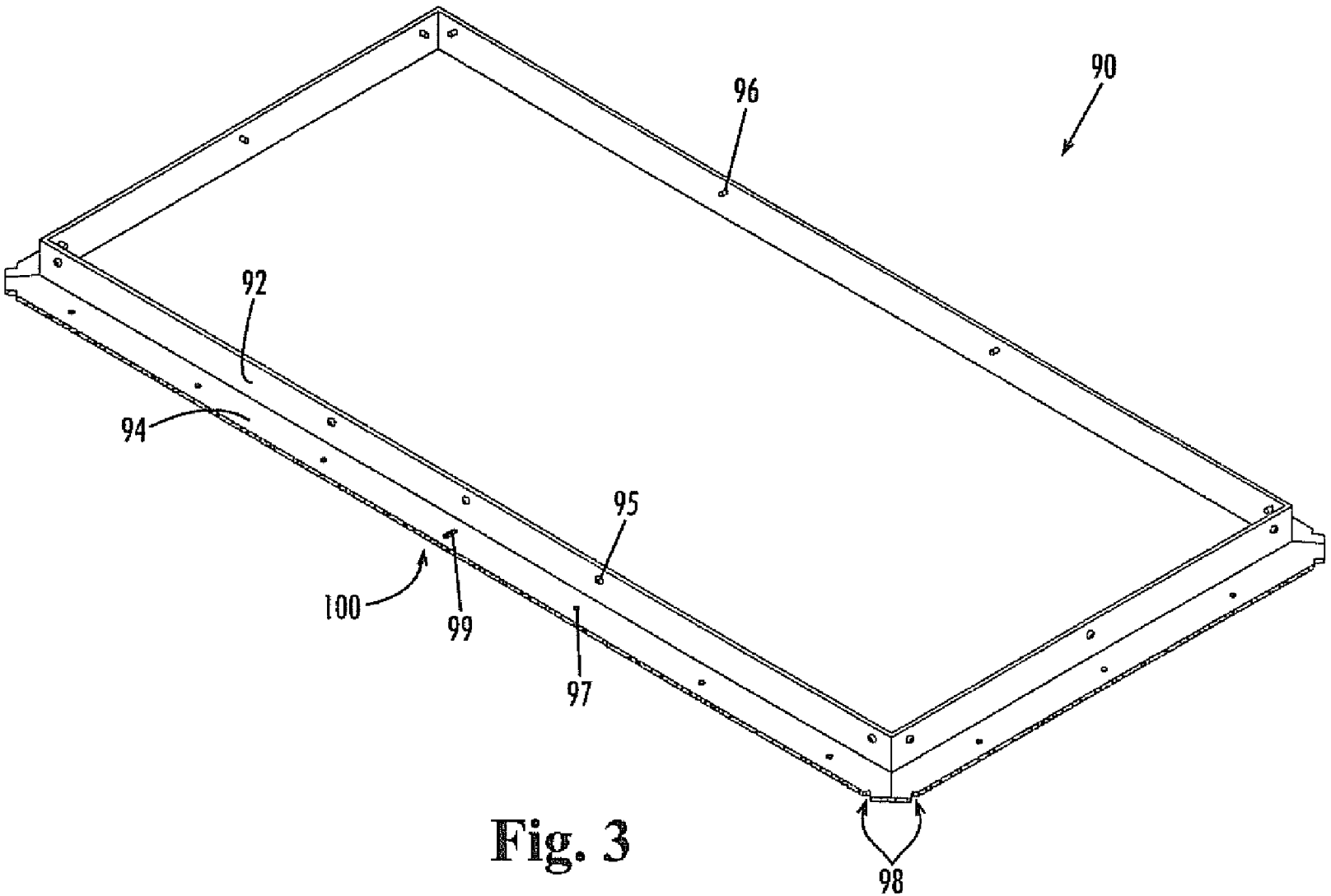
FIG. 3 is an isometric view of a deck-sealing surround, as may optionally be used with the deck-mounted skylight of FIG. 1.

FIG. 3 is an isometric view of a seamless deck-sealing surround 90 that may optionally be used with the skylight 10. The deck-sealing surround 90 may be a unitary member, as shown, which defines a rectangular perimeter. Each side of the rectangular perimeter may include an obtuse-angled profile, having a vertically extending surface 92 and a downwardly sloping surface 94 projecting away from the skylight 10, the surfaces 92, 94 defining therebetween an angle having a measurement of between greater than 90 degrees and less than 100 degrees. The vertically extending surfaces 92 are configured to abut the frame members 16, 18 of the skylight 10 as shown in FIGS. 4A and 5A, for example. Accordingly, the vertically extending surfaces 92 include a plurality of apertures 95 therethrough for receipt of a joining element (for example, screws 96 as shown) for securing the deck-sealing surround 90 to the skylight 10.

Similarly, the downwardly sloping surfaces 94 include a plurality of apertures therethrough for receipt of a joining element (not shown) for securing the deck-sealing surround 90 (and thereby the skylight assembly 10) to a rooftop. The downwardly sloping surfaces 94 along the longitudinal sides of the deck-sealing surround 90 may further include slot-shaped apertures 99, which may be used to temporarily position the deck-sealing surround 90 during skylight installation. These slot-shaped apertures 99 may be located toward the center of the longitudinal sides of the deck-sealing surround 90, or at either end, or at some location in-between. The downwardly sloping surfaces 94 may further include, at each end, one or more inwardly projecting notches 98 (more clearly seen in FIG. 4B), which may be useful in aligning the skylight 10 with chalk marks or other indicia on the roof. The underside of the downwardly sloping surfaces 94 (that is, the roof abutting sides) may include a layer of barrier material 20, such as a polyurethane foam or a thermoplastic elastomer. The deck-sealing surround 90 is described in greater detail in co-pending U.S. patent application Ser. No. 12/176,513, filed Jul. 21, 2008, the disclosure of which is hereby incorporated by reference.

FIG. 4A illustrates the deck-mounted skylight 10 of FIG. 1 including the unitary cladding component 50 of FIG. 2A and the deck sealing surround 90 of FIG. 3. As illustrated, the skylight 10 includes the covering element 12 surrounded by sash members 14, all of which are supported on a frame having a pair of longitudinal frame members 18 and pair of transverse frame members 16. Along the upper side 20 of the skylight 10 is positioned the protective headpiece 30 (shown in greater detail in FIG. 4B). Opposite the headpiece 30 along the lower side 22 of the skylight 10, the unitary cladding component 50 may be introduced onto the skylight assembly. The side panels (55) of the unitary cladding component 50 include a profile that is complementary to the gap between the sash members 14 and the frame members 18. Thus, the unitary cladding component 50 may be slidably engaged with the assembled skylight 10 without the need for tools or separate fasteners.

Figure 4B:
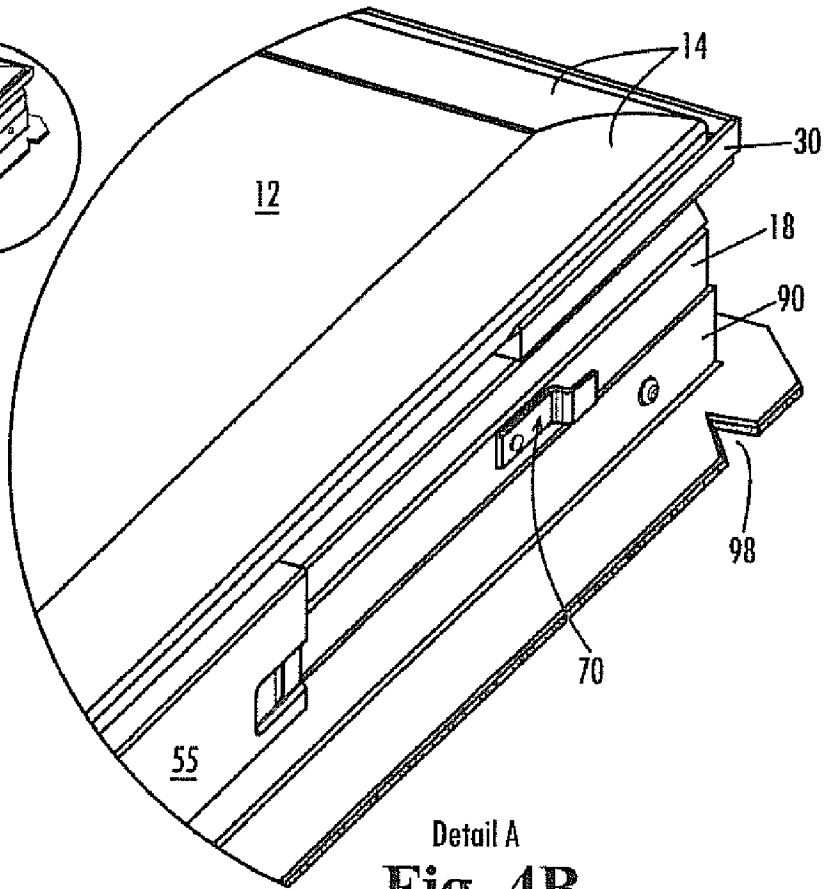
FIG. 4B is an enlarged isometric view of Detail A of FIG. 4A, showing a tab-type locking mechanism oriented for engagement with a corresponding slot in the side panel of the unitary cladding component.
Figure 4A:
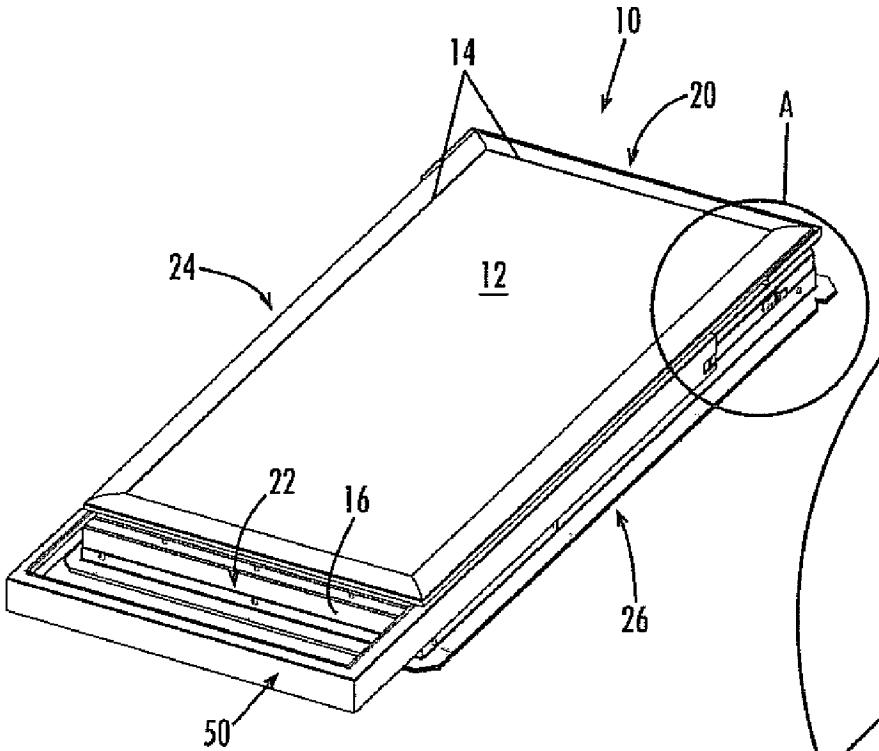
FIG. 4A is an isometric view of the deck-mounted skylight of FIG. 1 in which the cladding component of FIG. 2A is partially installed.

FIG. 4B illustrates a tab-type locking mechanism 70. The tab-type locking mechanism 70 may be secured to the longitudinal frame members 18 at a position proximate to the upper side 20 of the skylight 10. It should be understood that, while the right side 26 of the skylight assembly 10 is shown, a similar locking mechanism 70 is found on the left side 24, the tab-type locking mechanism 70 being spaced equidistant from the end of the frame members 18 to create a symmetrical cladding component 50.

Figure 4C:
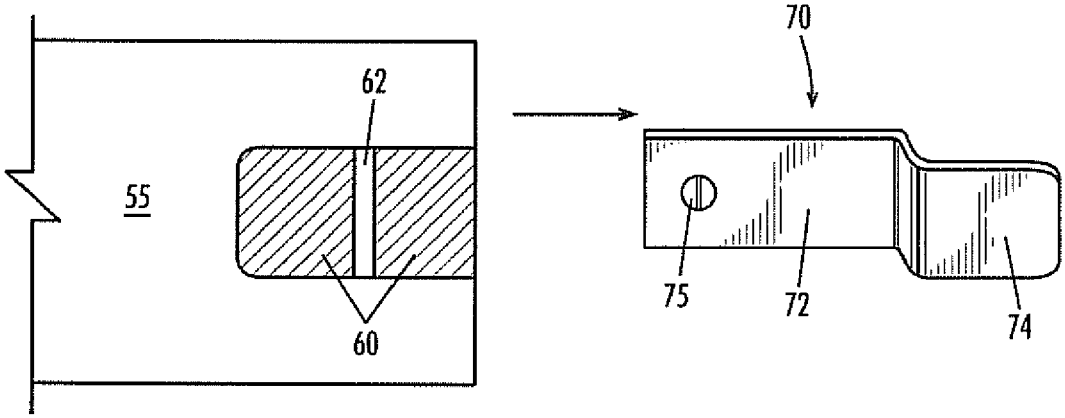
FIG. 4C is a schematic plan view of the lock-receiving slot of one side panel of the unitary cladding component and the corresponding tab-type locking mechanism, as shown in FIG. 4A.
Figure 4D:
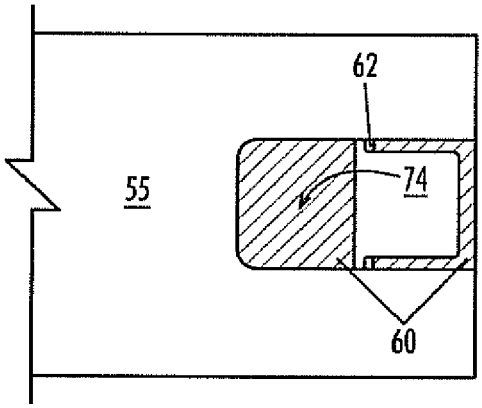
FIG. 4D is a schematic plan view of the initial interlocking relationship between the tab-type locking mechanism and the lock-receiving slot shown in FIG. 4C.
Figure 4E:
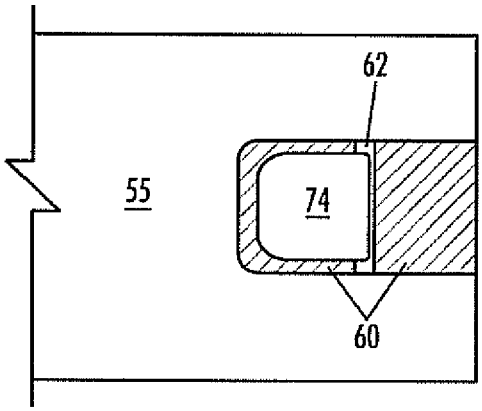
FIG. 4E is a schematic plan view of the tab-type locking mechanism and the corresponding lock-receiving slot of FIGS. 4A-4D, in a final interlocked configuration.

The tab-type locking mechanism 70 may be better understood with reference to FIGS. 4C-4E. As shown in FIG. 4C, the attachment end of the side panel 55 of the unitary cladding component (50) is disengaged from the tab-type locking mechanism 70. An arrow indicates the direction in which the side panel 55 may be moved to engage the tab lock 70. The side panel 55 may include a recessed panel 60 through which a slot-shaped aperture 62 is formed. The slot-shaped aperture 62 has dimensions complementary to those of the locking mechanism 70 and is oriented in parallel to the end of the side panel 55.

Each locking mechanism 70 includes a flat attachment panel 72, which abuts and is attached to one of the longitudinal frame members 18, and a tab, or engagement, portion 74, which is positioned through corresponding slot 62. The locking mechanism 70 may be attached to the respective longitudinal frame member 18 (not shown in this perspective) by a fastener 75, such as a screw.

FIG. 4D shows an intermediate, or initial, relationship between the locking mechanism 70 and the lock-receiving recess 60. As shown, the tab 74 slides through aperture, or slot, 62 and overlaps a portion of the recessed area 60 proximate to the end of the side panel 55 and the upper side (20) of the skylight (10). To secure the side panels 55 of the cladding component 50 to the longitudinal frame members 18, the tab 74 may be folded, as indicated by the arrow in FIG. 4D.

The resulting interlocking configuration is shown in FIG. 4E, in which the tab 74 is effectively folded over onto itself, being positioned over the opposite portion of the recessed area 60 (i.e., distal to the end of the side panel 55 and proximate to the lower side (22) of the skylight (10)). Thus, the tabs 74 fully interlock the side panels 55 of the cladding component (50) with the longitudinal frame members (18). Such interlocking, or engagement, between the locking mechanism 70 and the lock-receiving slot 62 of the side panels 55 secures the cladding component (50) around the frame members (16, 18), thus protecting the frame members (16, 18) from exposure to the elements.

Figure 4F:
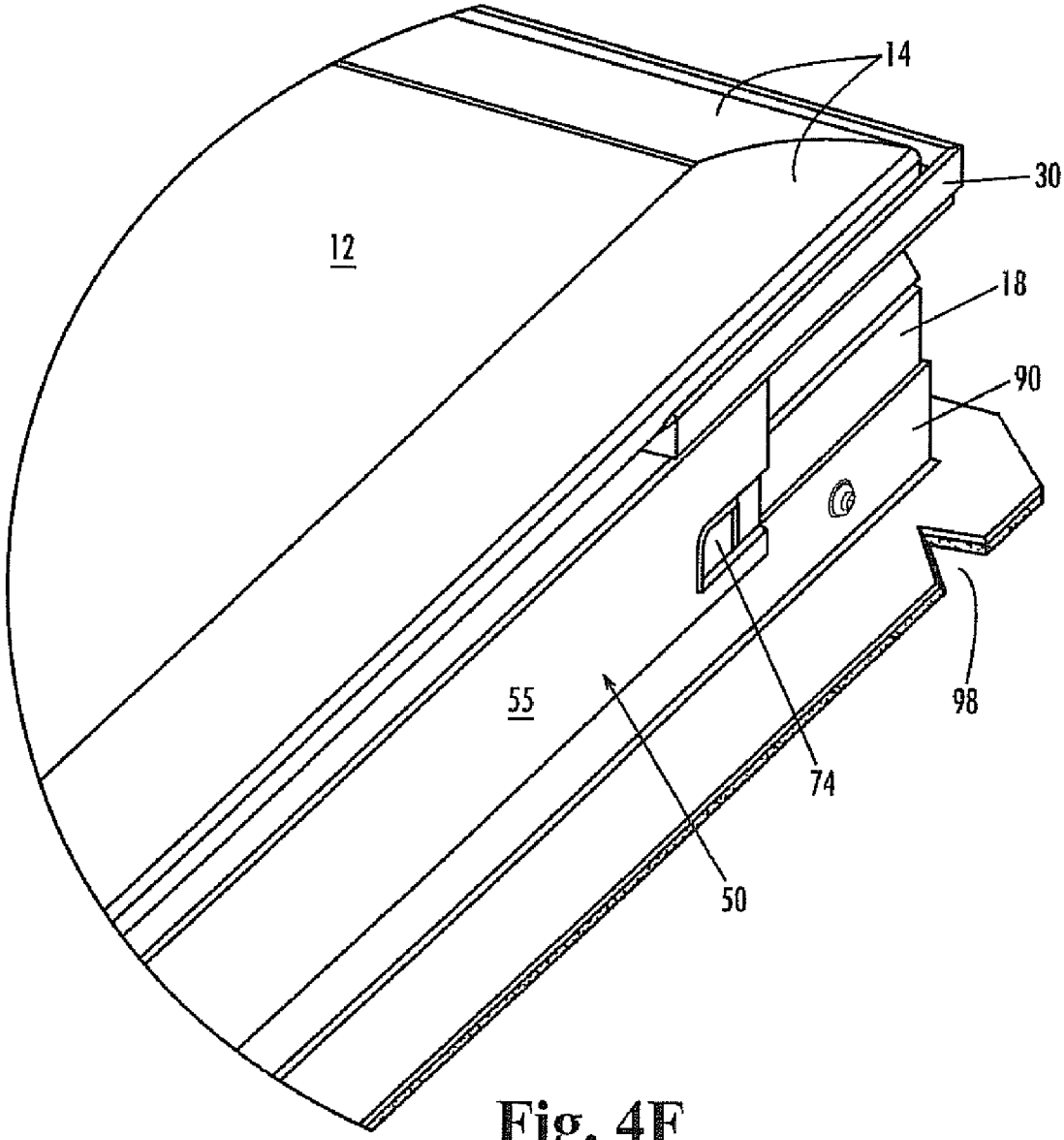
FIG. 4F is an enlarged isometric view of the deck-mounted skylight of FIG. 4A, in which the locking mechanism is engaged as shown in FIG. 4E.

As shown in FIG. 4F, the tab 74 of the locking mechanism (70) is engaged with a slot-shaped aperture (62) of the side panels 55 of the cladding component 50. The positioning of the locking mechanism (70) proximate to the upper end of the skylight 10 assures that a majority of the length of the longitudinal frame members 18 is protected by the cladding component 50. The lower half of the longitudinal frame members 18 (and the transverse frame members 16, not shown in this view) may be effectively protected by the inclusion of the deck-sealing surround 90, which also facilitates installation of the skylight 10 within an opening in a building roof.

FIG. 5A illustrates the skylight 10 having an alternate cladding component 50'. As before, the cladding component 50' may be slidably engaged with the skylight 10 by positioning its side panels 55' along the respective left and right sides 24, 26 of the skylight 10. The unitary cladding component 50' includes a central panel configured to cover the transverse frame member 16 located at the lower side 22 of the skylight 10. The cladding component 50' further includes, at either end, a keyhole-shaped slot (64) in the side panels 55'.

Figure 5B:
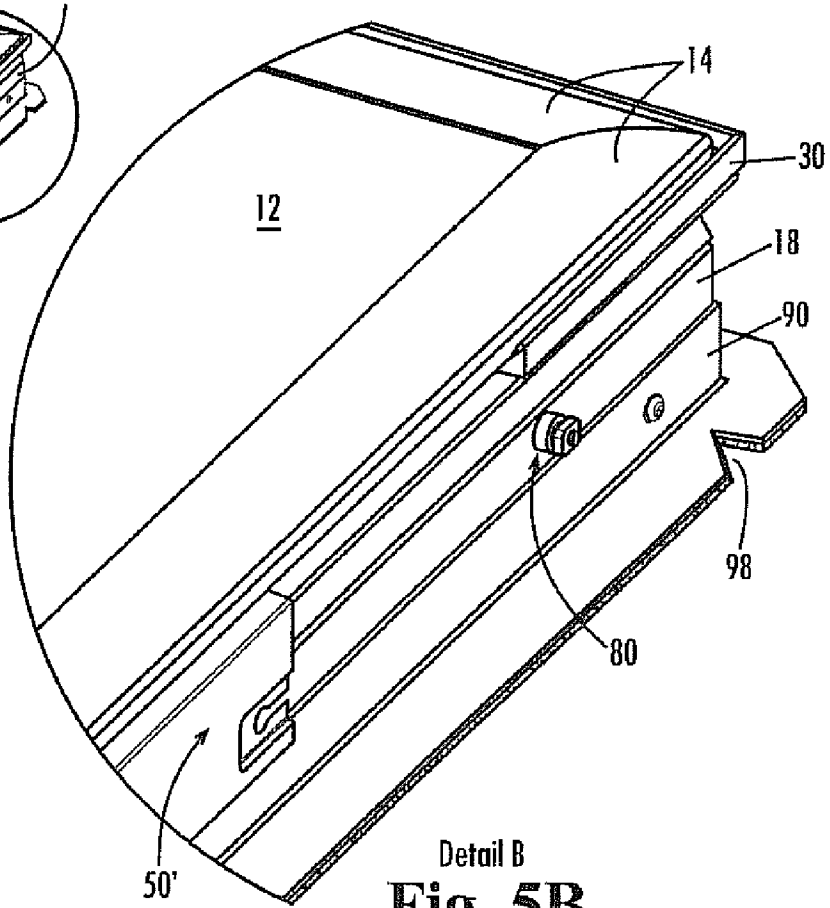
FIG. 5B is an enlarged isometric view of Detail B of FIG. 5A, showing a latch-type locking mechanism oriented for engagement with a corresponding keyhole-shaped slot in the side panel of the unitary cladding component.
Figure 5A:
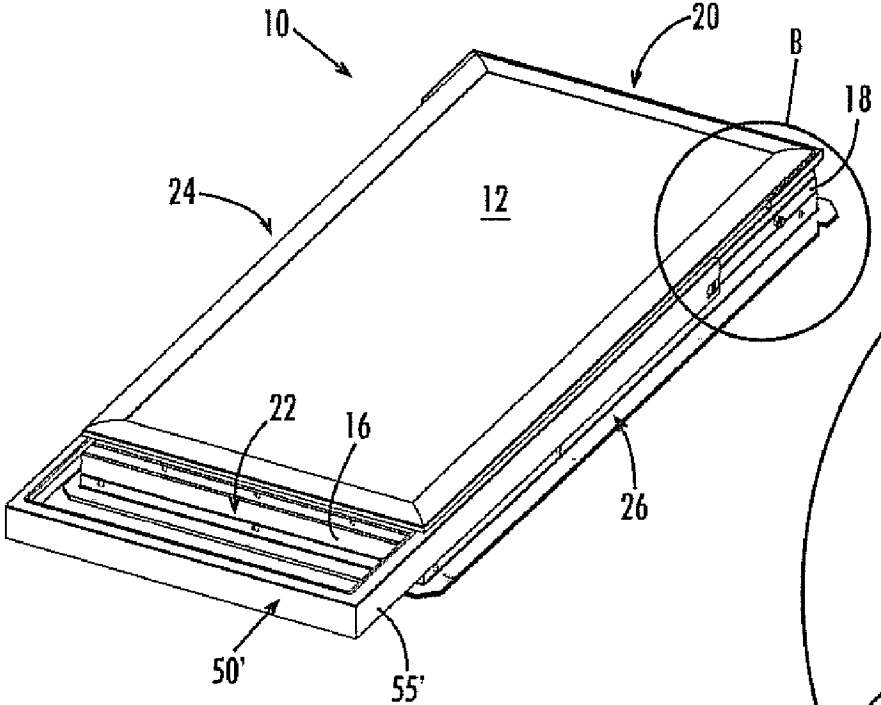
FIG. 5A is an isometric view of a deck-mounted skylight of FIG. 1, showing an alternate unitary cladding component in a partially installed position.

FIG. 5B illustrates the arrangement of the cladding component 50' as disengaged from a latch-type locking component 80, which is affixed to the longitudinal frame member 18. As with the tab-type locking mechanism 70, shown in FIG. 4B, each latch-type locking mechanism 80 may be securely attached to a respective longitudinal frame member 18 at a position proximate to the upper side 20 of the skylight 10 and at a predetermined distance from the end of the frame member 18.

Figure 5C:
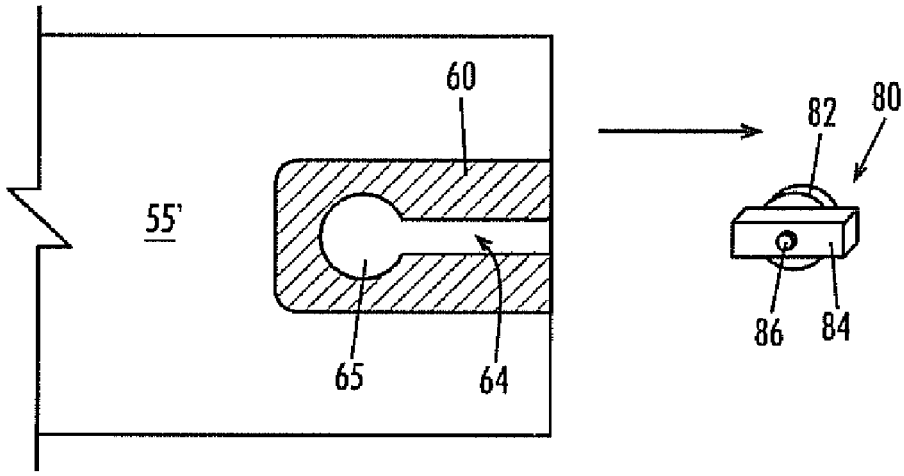
FIG. 5C is a schematic plan view of the lock-receiving slot of one side panel of the unitary cladding component and a corresponding latch-type locking mechanism, as shown in FIG. 5A.
Figure 5D:
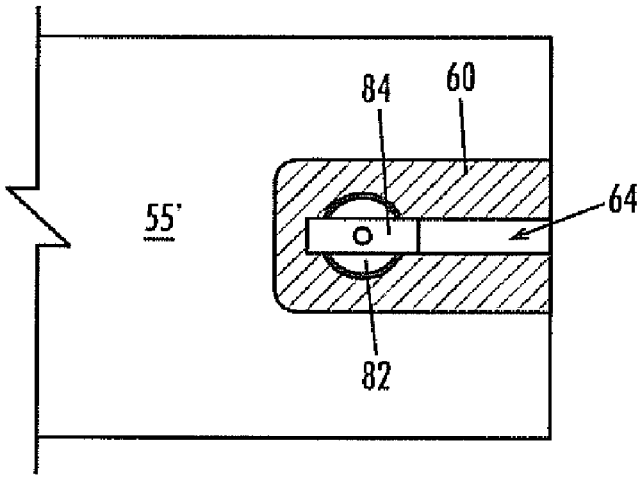
FIG. 5D is a schematic plan view of an initial interlocking relationship between the latch-type locking mechanism and the keyhole lock-receiving slot shown in FIG. 5C.
Figure 5E:
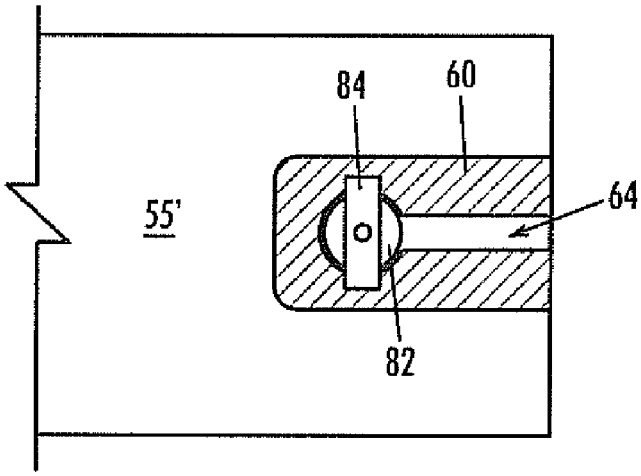
FIG. 5E is a schematic plan view of the latch-type locking mechanism and the corresponding lock-receiving slot of FIGS. 5A-5D, in a final, interlocked position.

The engagement of the latch-type locking mechanism 80 with the keyhole-type slot 64 may be more clearly understood with reference to FIGS. 5C-5E. As shown in FIG. 5C, the side panel 55' of the cladding component (50') includes a recessed area 60 along an end thereof opposite the central panel of the cladding component (50'). The recessed area 60 includes a keyhole-shaped aperture 64 having an inwardly-extending slot, which terminates in a rounded aperture 65. The latch-type locking mechanism 80 includes a circular base 82 to which is secured a rectangular latch 84, the latch 84 being secured to the base 82 by a pin 86 that extends into the longitudinal frame member 18.

As indicated by the arrow, the side panel 55' of the cladding component (50') may be moved toward the latch-type locking mechanism 80 for engagement therewith. The initial engagement between the locking mechanism 80 and the keyhole-type aperture 64 may be seen in FIG. 5D. As shown, the base 82 is positioned within the circular opening 65, and the latch 84 is aligned with the slot 64. The latch 84 may be rotated (e.g., 90 degrees) in either a clockwise or counter-clockwise direction as indicated by the arrow in FIG. 5D to interlock the side panels 55' of the cladding component (50') to the longitudinal frame members (18), as shown in FIGS. 5E and 5F.

Figure 5F:
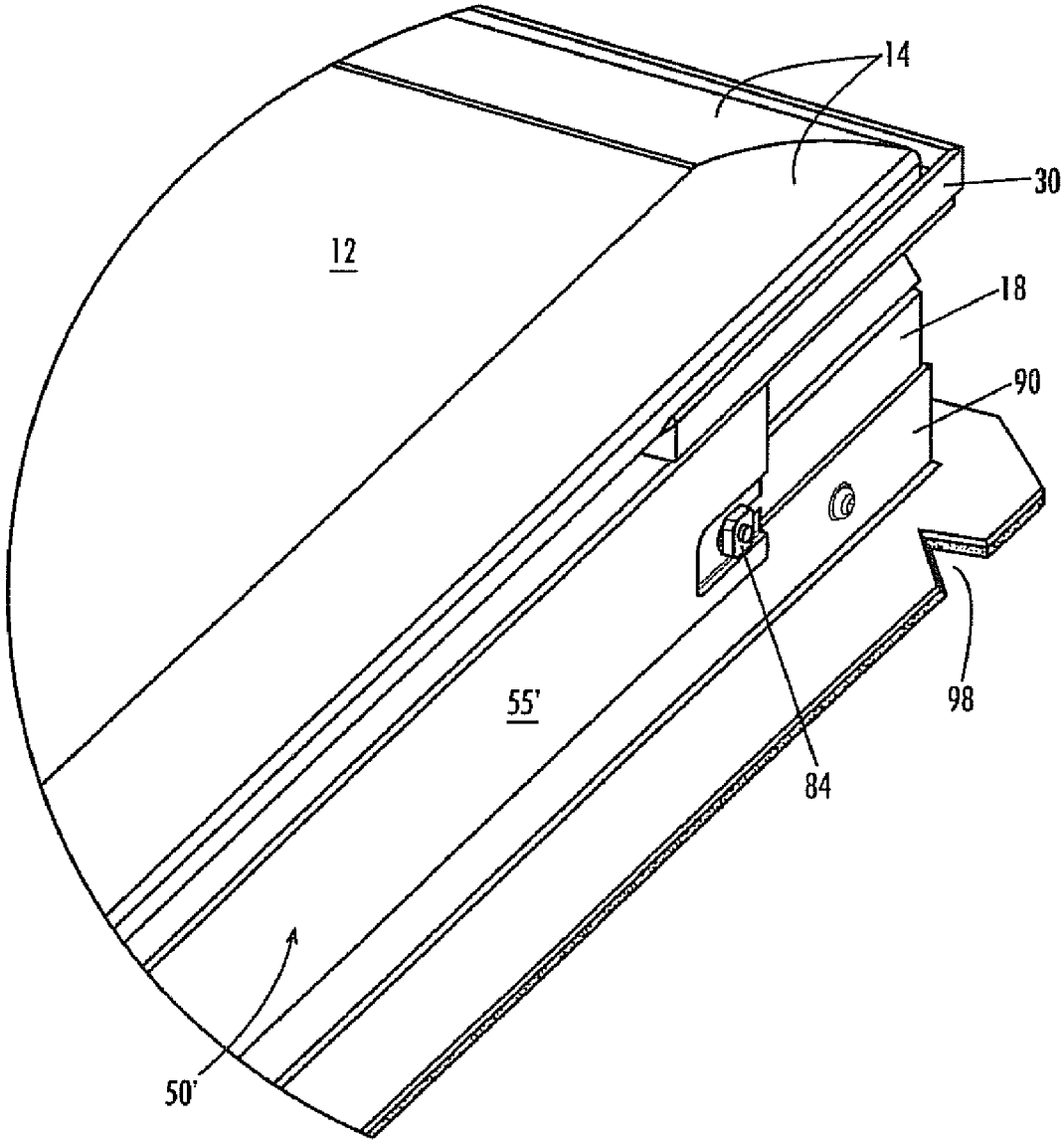
FIG. 5F is an enlarged isometric view of the deck-mounted skylight of FIG. 5A, in which the latch-type locking mechanism is interlocked as shown in FIG. SE.

FIG. 5F shows the interlocked relationship between the latch-type locking mechanism 80 and the keyhole-shaped slot 64 of the side panels 55'. When the cladding component 50' is positioned around the frame members 16, 18 and the latch components 84 are engaged, the unitary cladding component 50' is securely held about the skylight 10, thus protecting a majority of the length of the frame members 16, 18 from damage due to exposure. As with the skylight shown in FIG. 4F, a deck-sealing surround 90 may further protect the lower half of the frame members 16, 18, In addition, a headpiece 30 may be positioned around the upper side of the skylight assembly 10.

Figure 6:
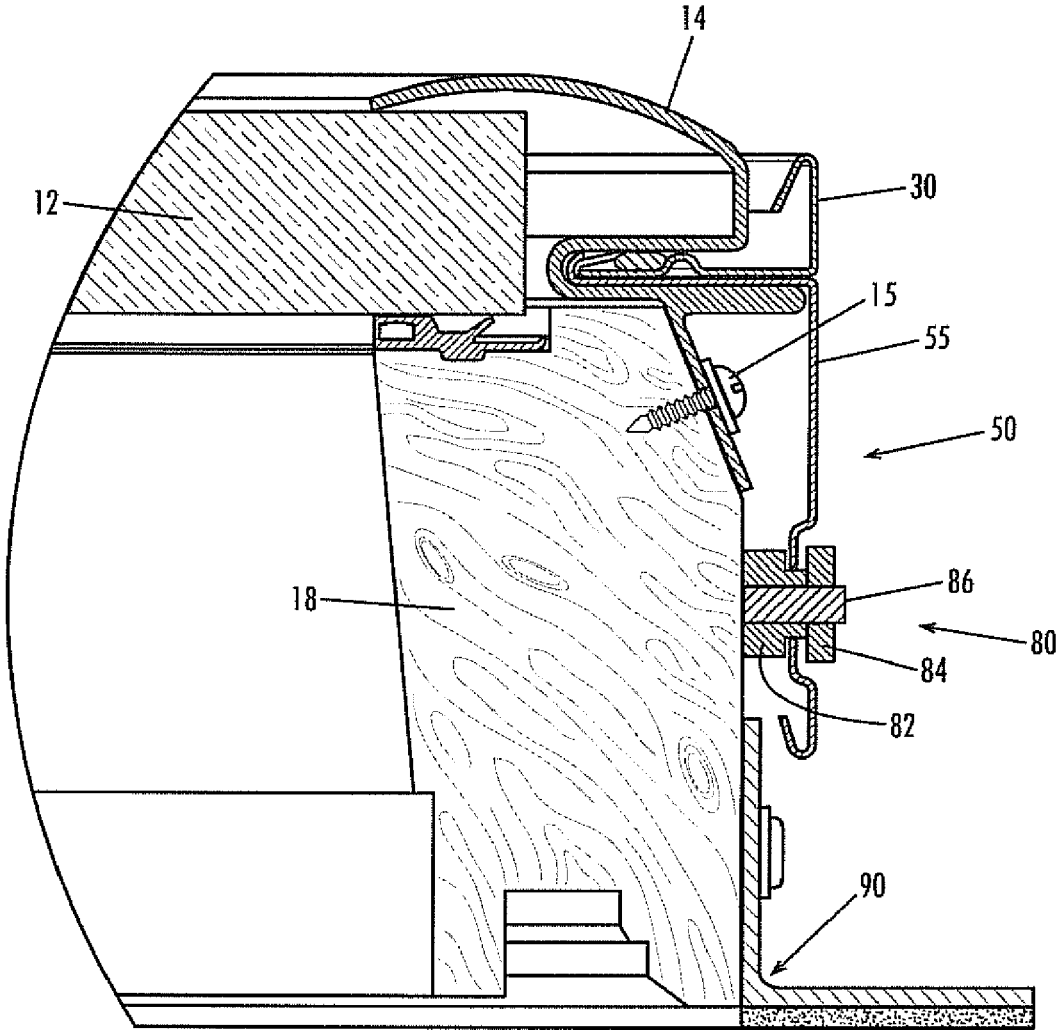
FIG. 6 is a cross-sectional view of the present deck-mounted skylight of FIG. 5F in which a unitary cladding component has been installed.

A cross-section of the skylight 10 as shown in FIG. 5F may be seen in FIG. 6. As shown, the longitudinal frame member 18 supports the covering element 12, which is held in its position by the sash member 14. The sash member 14 is configured with a rounded portion in contact with the covering element 12 and with an angular portion in contact with a similarly angled frame member 18. Such configuration facilitates the run-off of rainwater and other precipitation from the skylight 10. In addition, the placement of the sash attachment screw 15 along the angular portion of the sash member 14 (where the screw 15 is covered by the cladding component 50) significantly reduces the likelihood of the frame members 18 from being rotted, or otherwise damaged, by precipitation seeping into the frame members 18 from the opening for the screw 15. Although the screw 15 is shown as having a domed head accompanied by a washer, other screw types or lengths may instead be used.

FIG. 6 also shows the cladding component 50 in an engaged relationship with the locking mechanism 80. The headpiece 30, which protects the upper side 20 of the skylight 10, is shown in a position above the cladding 50. The deck-sealing surround 90 may be secured to the lower portion of the longitudinal frame members 18. The cladding component 50 and the deck-sealing surround 90 thus cover a majorty of the exposed exterior surfaces of the longitudinal frame members 18 and the transverse frame member 16 along the lower side 22 of the skylight 10. A head flashing member (for example, 120, as shown in FIG. 7A) may be used to fully cover the exposed areas of the transverse frame member 16 on the upper side 20 of the skylight 10.

According to a second embodiment of the present disclosure, an alternate cladding component may be seen in FIGS. 7A, 7B, 8A, and 8B, in which the cladding component (150, 150', respectively) may be provided with an attached tab-type locking mechanism (140, 140', respectively) that engages a slot-shaped aperture (122, 132, respectively) in the aforementioned head flashing member (120, 130, respectively). In this embodiment, the cladding component bears the locking mechanism, while the head flashing member provides a receptacle for receiving the locking mechanism. Variations of this approach are described as follows, with reference to FIGS. 7A and 7B and FIGS. 8A and 8B.

As mentioned briefly above, the skylight 10 may be outfitted with a head flashing member 120 (or 130) along the upper side 20 of the skylight 10. The head flashing member 120 (or 130) includes a number of vertical surfaces, which abut the frame members 16, 18 of the skylight 10, and a number of horizontal surfaces, which abut the roof. The head flashing member 120 (or 130) , therefore, may be said to have a C-shape, having a central portion 120*b* (or 130*b*) that is complementary in size and shape to the upper side 20 of the skylight 10 and having arms 120*a* (or 130*a*) that extend downwardly onto the left and right sides 24, 26, respectively, the head flashing member 120 (or 130) being so configured to cover the exposed areas of the underlying frame members 16, 18. The head flashing member 120 (or 130) has a profile that engages and covers the headpiece 30 installed on the upper side 20 of the skylight 10.

Figure 7A:
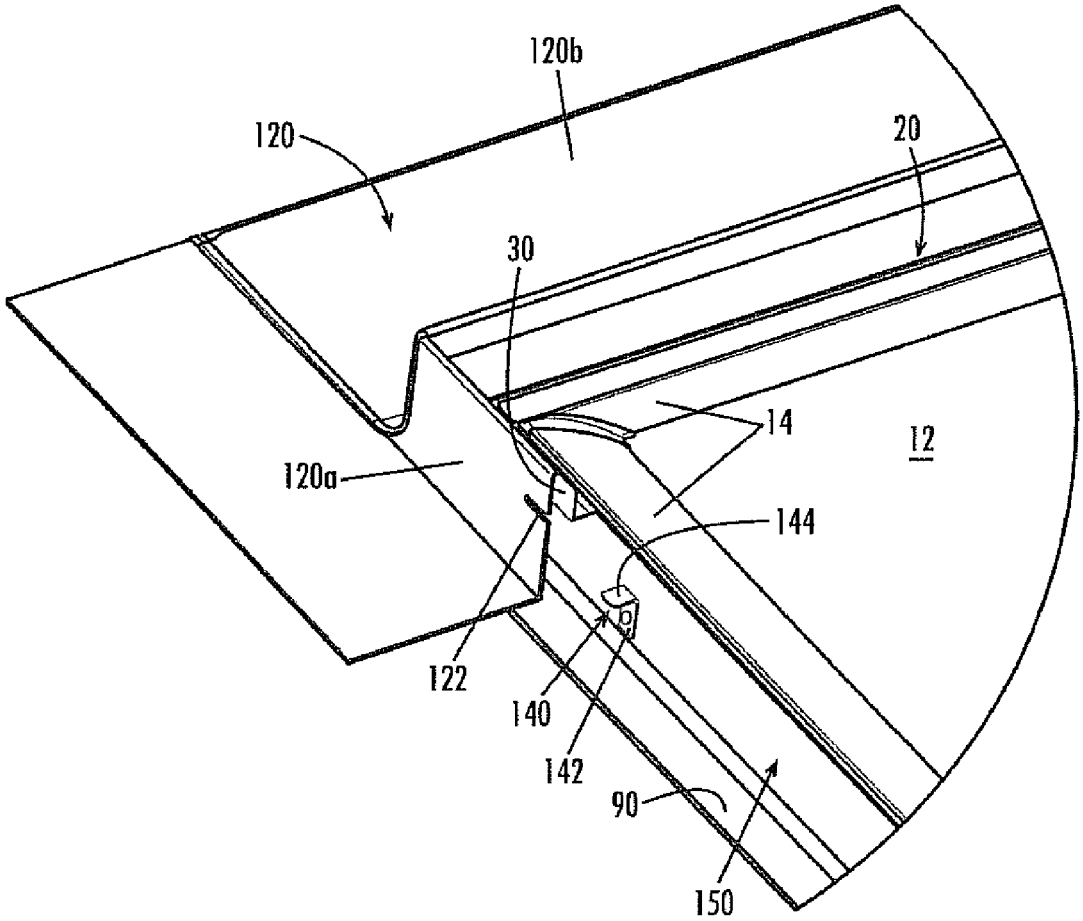
FIG. 7A is an isometric view of another alternate unitary cladding component, as installed around a skylight and as positioned for engagement with a head flashing member.
Figure 7B:
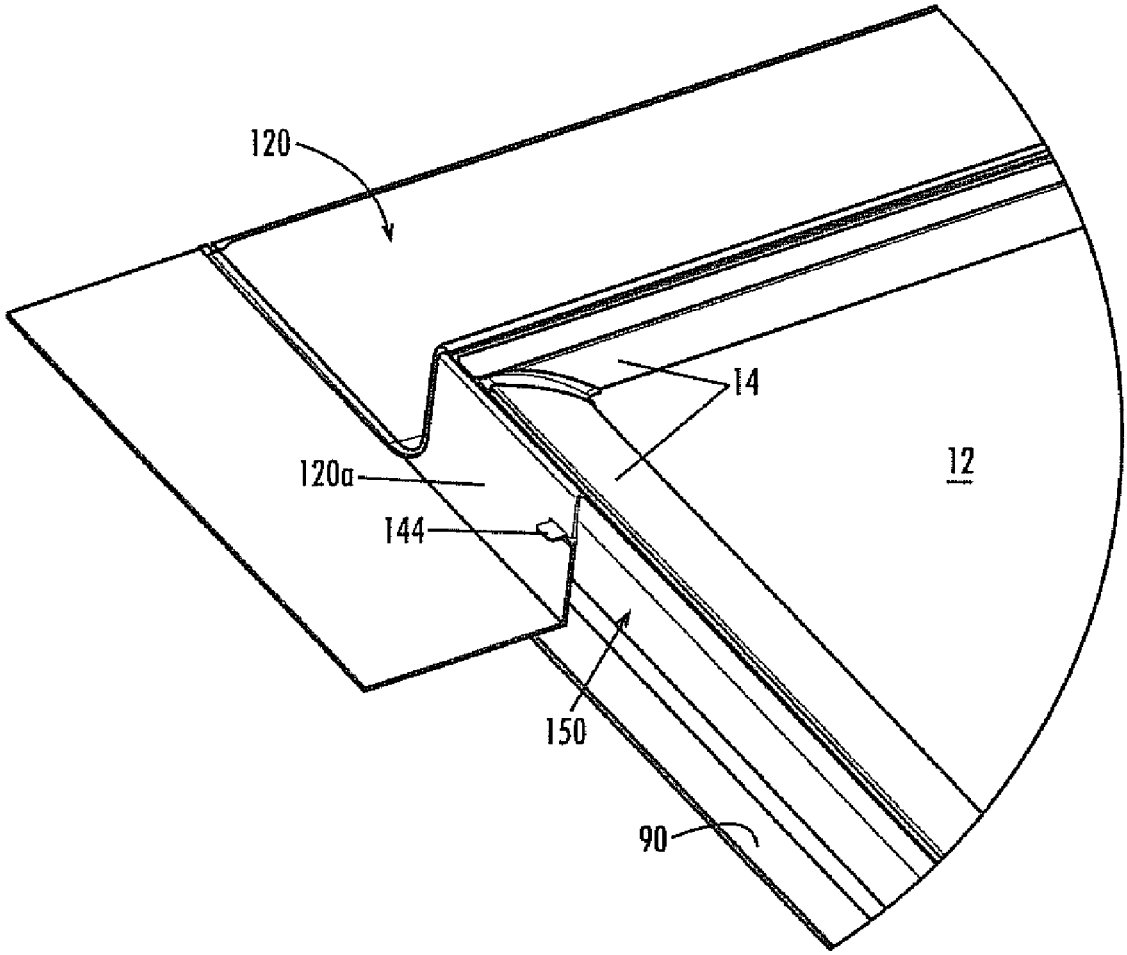
FIG. 7B is an isometric view of the assembly of FIG. 7A, in which a tab-type locking mechanism of the unitary cladding component is received within a slot of the head flashing member.

As seen in FIGS. 7A and 7B, the arm portions 120*a* of the head flashing member 120 include a slot 122 extending inwardly from, and perpendicularly to, the end of the arm portions 120*a*. The slot 122 is oriented in parallel to the covering element 12. A unitary, or seamless, cladding component 150 is provided with a tab-type locking mechanism 140 at each end thereof (that is, distal to the central bottom panel, not shown in this view), which is positioned to align with the slot 122. The tab-type locking mechanism 140 may be essentially L-shaped and may have an attachment panel 142 and an engagement panel 144.

As shown in FIG. 7A, the L-shaped tab 140 may be affixed to the exterior of the cladding component 150, such that the engagement panel 144 of the tab 140 is parallel to the plane of the covering element 12. It should be noted that, although the tab 140 is shown with the engagement panel 144 positioned above the attachment panel 142 (i.e., proximate the covering element 12), the opposite configuration may instead be used, provided the engagement panel 144 of the tab 140 is properly aligned with the slot 122 in the head flashing member 120. As with the cladding component 50 (shown, for example, in FIG.

4A), the cladding component 150 features a profile complementary to the sash members 14 and the frame members 16, 18 of the skylight 10.

FIG. 7B shows the initial interlocking relationship between the engagement panel 144 of the tab 140 and the slot-shaped aperture (122) of the head flashing member 120. As illustrated, the tab panel 144 is positioned into the slot (122), for example, by sliding the head flashing member 120 onto the upper side 20 of the skylight 10. Once the head flashing member 120 is appropriately situated, the engagement panel 144 of the tab 140 may be bent, either upward or downward, to interlock the cladding component 150 and the head flashing member 120. In this manner, especially when a deck surround 90 is also employed, the exterior surface area of the frame members (16, 18) may be fully enclosed, thus minimizing the likelihood of structural damage from exposure to weather or insects, for instance.

Figure 8A:
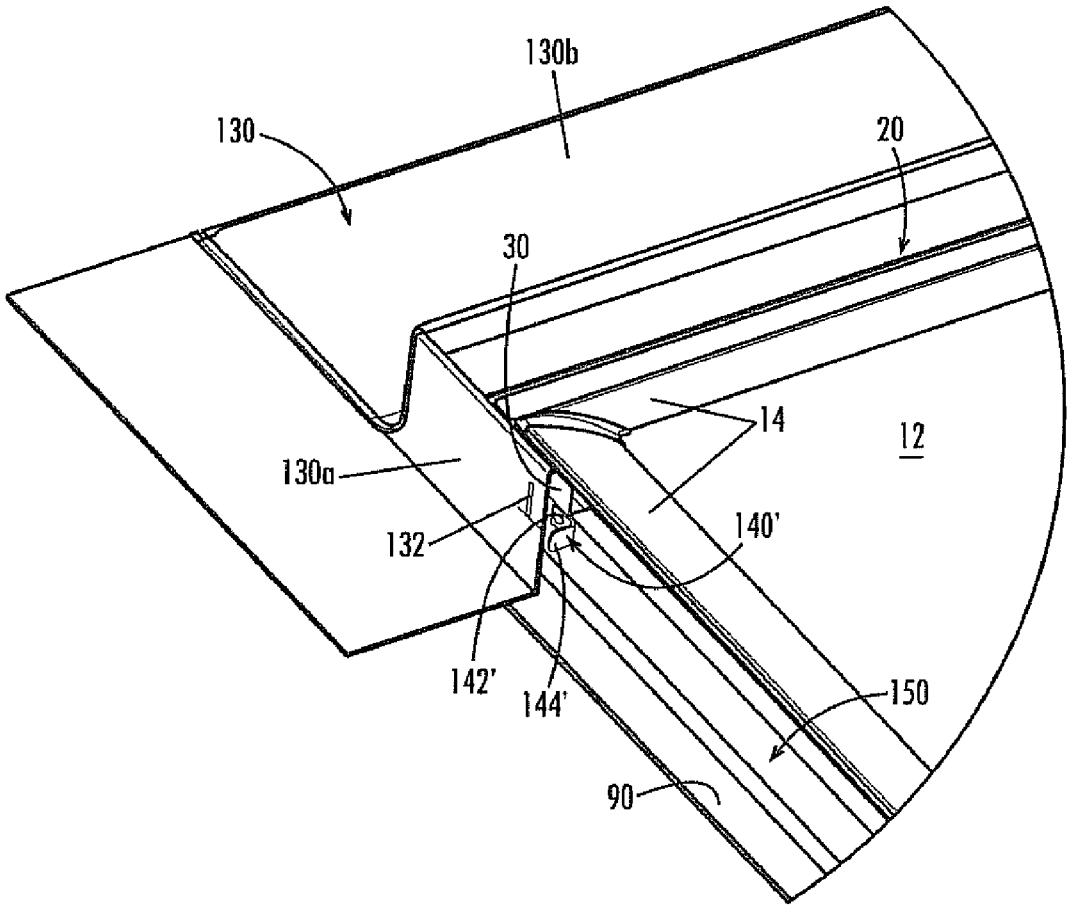
FIG. 8A is an isometric view of yet another alternate unitary cladding component, as installed around a skylight and as positioned for engagement with a head flashing member.
Figure 8B:
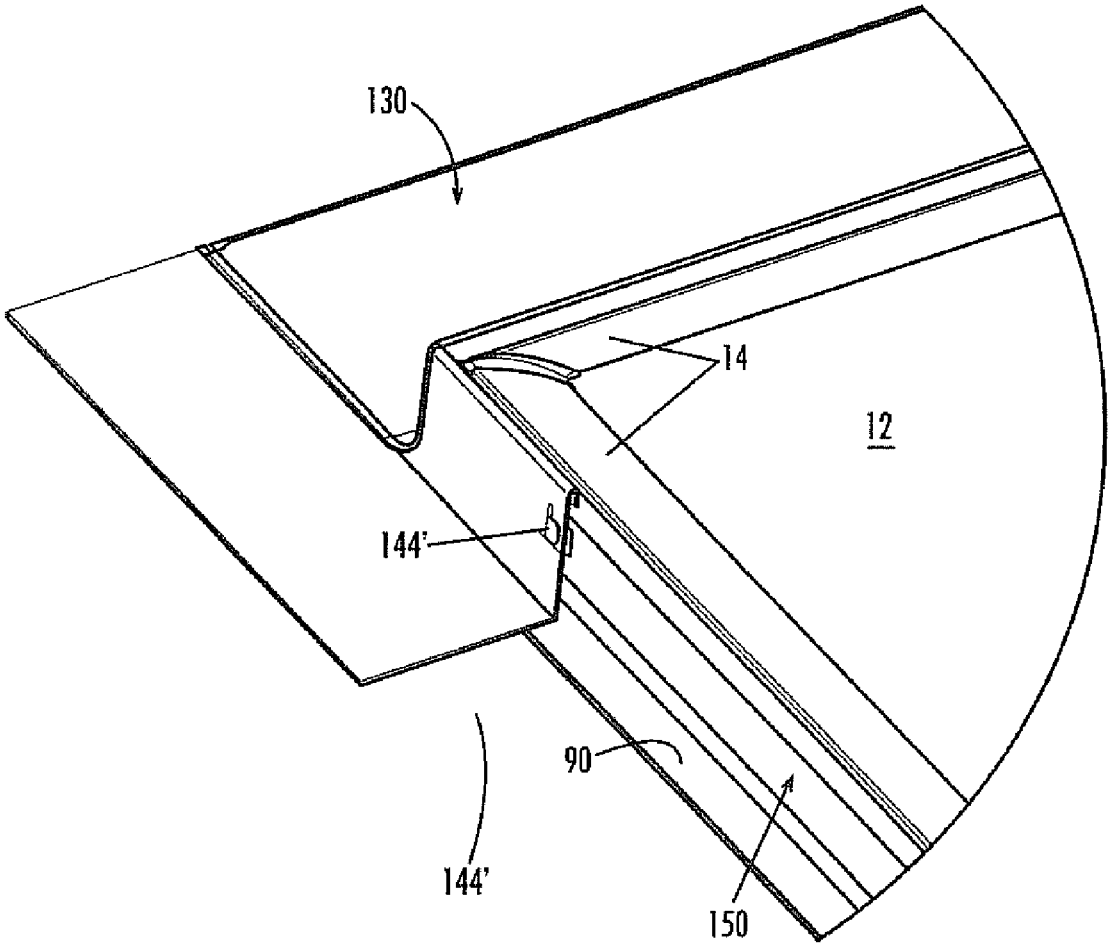
FIG. 8B is an isometric view of the assembly of FIG. 8A, in which a tab-type locking mechanism of the unitary cladding component is received within a slot of the head flashing member.

Turning now to FIGS. 8A and 8B, the arm portions 130*a* of the head flashing member 130 include a slot 132 inward from, and parallel to, the end of the arm portions 130*a* and perpendicularly to the covering element 12. A unitary, or seamless, cladding component 150' is provided with a tab-type locking mechanism 140' at each end thereof (that is, distal to the central bottom panel, not shown in this view), which is positioned to align with the slot 132. The L-shaped tab-type locking mechanism 140' includes an attachment panel 142' and an engagement panel 144'.

As shown in FIG. 8A, the L-shaped tab 140' may be affixed to the exterior of the cladding component 150', such that the engagement panel 144' of the tab 140' is perpendicular to the plane of the covering element 12. It should be noted that, although the tab 140' is shown with the attachment panel 142' positioned proximate the upper side 20, the opposite configuration may instead be used, provided the engagement panel 144' of the tab 140' is properly positioned to align with the slot 132 in the head flashing member 130. Further, it will be appreciated that the arm portions 130*a* of the head flashing member 130 may be extended away from the frame members 18 (for example, by gently pulling the arm portions 130*a*) until the head flashing member 130 is aligned with the engagement panel 144' of the tab 140', at which occurrence engagement panel 144' may be positioned through the slot-shaped aperture 132 and bent, as shown in FIG. 8B.

FIG. 8B shows the interlocking relationship between the engagement panel 144' of the tab 140' and the slot-shaped aperture (132) of the head flashing member 130. As illustrated, the tab panel 144' is positioned into the slot (132), for example, by sliding the head flashing member 130 onto the upper side 20 of the skylight 10. Once the head flashing member 130 is appropriately situated, the engagement panel 144' of the tab 140' may be bent, either forward or backward, to interlock the cladding component 150' and the head flashing member 130. In this manner, especially when a deck surround 90 is also employed, the exterior surface area of the frame members (16, 18) may be fully enclosed, thus minimizing the likelihood of structural damage from exposure to weather or insects, for instance.

The preceding discussion merely illustrates the principles associated with using a unitary cladding component to facilitate installation thereof by eliminating the necessity for tools and separate fasteners, which may be difficult to maneuver, particularly at rooftop elevations and slopes. It will thus be appreciated that those skilled in the art will be able to devise various arrangements, which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the inventions and the concepts contributed by the inventor(s) to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawings, which are to be considered part of the entire description of the invention. In the description, relative terms such as "lower", "upper", "horizontal", "vertical", "above", "below", "up", "down", "top" and "bottom", as well as derivatives thereof (e.g., "horizontally", "downwardly", etc.) should be construed to refer to the orientation as then described or as shown in the drawing under discussion. These relative terms are for convenience of description and do not required that the apparatus be constructed or operated in a particular orientation, unless otherwise indicated. Terms concerning attachment, coupling, and the like, such as "connected", "attached", or "interconnected", refer to a relationship wherein structures are secured or attached to one another either directly or indirectly through intervening structures, as well as both movable or rigid attachments or relationships, unless expressly described otherwise.

The foregoing description provides a teaching of the subject matter of the appended claims, including the best mode known at the time of filing, but is in no way intended to preclude foreseeable variations contemplated by those of skill in the art.

We claim:

1. A deck-mounted skylight installed about an opening in a building roof, the skylight comprising:

a covering element;

a frame comprising a pair of longitudinal frame members and a pair of transverse frame members, the frame members surrounding the opening and having an interior side and an exterior side, each of the longitudinal frame members having a first length and further having a locking mechanism on the exterior side thereof at a location proximate an end of the longitudinal frame members;

a sash securing the covering element to the frame; and a unitary U-shaped cladding component having a bottom panel and a pair of side panels extending from the bottom panel, each of the bottom panel and the side panels having a profile engaging the sash, the cladding component being slidably engaged with the frame, such that the bottom panel covers one of the transverse frame members, and the side panels cover a majority of the first length of the longitudinal frame members, each of the side panels further having a lock-receiving slot at an end thereof distal to the bottom panel through which lock-receiving slot the locking mechanism of the longitudinal frame member is received.

2. The skylight of claim 1, wherein the locking mechanism comprises a bendable tab and the lock-receiving slot is oriented to receive the bendable tab.

3. The skylight of claim 1, wherein the locking mechanism comprises a rotatable latch and the lock-receiving slot comprises an aperture having a profile engageable with the rotatable latch.

4. The skylight of claim 1, further comprising a headpiece, the headpiece covering a transverse frame member opposite the frame member covered by the bottom panel.

5. The skylight of claim 1, wherein the covering element comprises one of a single glass panel, a dual-pane glass panel, and a dome.

6. The skylight of claim 5, wherein the covering element comprises a dual-pane glass panel.

7. A method for installing cladding around a deck-mounted skylight, the skylight being installed about an opening in a building roof, the method comprising:

providing a skylight having a covering element; a frame comprising a pair of longitudinal frame members and a pair of transverse frame members, the frame members surrounding the opening and having an interior side and an exterior side, each of the longitudinal frame members having a first length and further having a locking mechanism on the exterior side thereof at a location proximate an end of the longitudinal frame members; and a sash securing the covering element to the frame;

providing a unitary U-shaped cladding component having a bottom panel and a pair of side panels extending from the bottom panel, each of the bottom panel and the side panels having a profile configured to engage the sash, and each of the side panels further having a lock-receiving slot at an end thereof distal to the bottom panel;

slidably engaging the cladding component with the frame, such that the bottom panel covers one of the transverse frame members, and the side panels cover a majority of the first length of the longitudinal frame members; and engaging the locking mechanism with the lock-receiving slot to secure the cladding component to the skylight.

8. The method of claim 7, wherein the bottom panel of the cladding component covers the lower of the transverse frame members.

9. The method of claim 7, wherein the locking mechanism comprises a bendable tab, and the lock-receiving slot is oriented to receive the bendable tab.

10. The method of claim 7, wherein the locking mechanism comprises a rotatable latch, and the lock-receiving slot comprises a keyhole-shaped aperture configured to engage the rotatable latch.

11. The method of claim 7, further comprising providing a headpiece and installing the headpiece to cover one of the transverse frame members opposite the transverse frame member covered by the bottom panel of the cladding component.

12. The method of claim 11, further comprising providing a head flashing member and installing the head flashing member over the headpiece.

13. A deck-mounted skylight installed about an opening in a building roof, the skylight comprising:

a covering element;

a frame comprising a pair of longitudinal frame members and a pair of transverse frame members, the frame members surrounding the opening and having an exterior side, each of the longitudinal frame members having a first length;

a sash securing the covering element to the frame;

a unitary U-shaped cladding component having a bottom panel and a pair of side panels extending from the bottom panel, each of the bottom panel and the side panels having a profile engaging the sash and further having an interior and an exterior, the cladding component being slidably engaged with the frame, such that the interior of the bottom panel covers the exterior of one of the transverse frame members, and the interior of the side panels cover a majority of the first length of the exterior of the longitudinal frame members, each of the side panels further having a locking mechanism attached to the exterior thereof at an end distal to the bottom panel; and a head flashing member having a central portion and a pair of arms extending from the central portion, the head flashing member being slidably engaged with the frame to cover one of the transverse frame members opposite the cladding component, each arm of the head flashing member having at an end thereof a slot-shaped aperture, the locking mechanism of the cladding component being positioned through the aperture.

14. The skylight of claim 13, wherein the locking mechanism is a bendable tab having an attachment panel and an engagement panel, the attachment panel being attached to the exterior of the cladding component and the engagement panel being bent about the aperture.

15. The skylight of claim 14, wherein the slot-shaped aperture and the engagement panel of the bendable tab, before bending, are parallel to the plane of the covering element.

16. The skylight of claim 15, wherein the bendable tab is oriented such that the engagement panel is proximate to the covering element.

17. The skylight of claim 13, wherein the slot-shaped aperture and the engagement panel of the bendable tab, before bending, are perpendicular to the plane of the covering element.

18. The skylight of claim 17, wherein the bendable tab is oriented such that the attachment panel is proximate to the head flashing member.

19. A method for installing cladding around a deck-mounted skylight, the skylight being installed about an opening in a building roof, the method comprising:

providing a skylight having a covering element; a frame comprising a pair of longitudinal frame members and a pair of transverse frame members, the frame members surrounding the opening and having an exterior side, each of the longitudinal frame members having a first length; and a sash securing the covering element to the frame;

providing a unitary U-shaped cladding component having a bottom panel and a pair of side panels extending from the bottom panel, each of the bottom panel and the side panels having a profile configured to engage the sash and further having an interior and an exterior, and each of the side panels further having a locking mechanism attached to the exterior thereof at an end distal to the bottom panel;

slidably engaging the cladding component with the frame, such that the interior of the bottom panel covers the exterior of one of the transverse frame members, and the interior of the side panels cover a majority of the first length of the exterior of the longitudinal frame members;

providing a head flashing member having a central portion and a pair of arms extending from the central portion, each arm of the head flashing member having at an end thereof a slot-shaped aperture;

slidably engaging the head flashing member with the frame to cover one of the transverse frame members opposite the cladding component; and engaging the locking mechanism of the cladding component with the slot-shaped aperture of the head flashing member.

20. The method of claim 19, comprising providing, as the locking mechanism, a bendable tab having an attachment panel and an engagement panel, attaching the attachment panel to the exterior of the cladding component, and bending the engagement panel about the aperture.

21. The method of claim 20, further comprising orienting the bendable tab such that the engagement panel is proximate to the covering element and, before being engaged, is parallel to the plane of the covering element.

22. The method of claim 20, further comprising orienting the bendable tab such that the attachment panel is proximate to the head flashing member and the engagement panel is perpendicular to the plane of the covering element before being engaged.

* * * * *